US005618023A

United States Patent [19]

Eichholz et al.

[11] Patent Number: 5,618,023

[45] Date of Patent: Apr. 8, 1997

[54] PLUMBING FIXTURE WITH LINE-POWERED CONTROL UNIT

[75] Inventors: Heinz-Dieter Eichholz, Iserlohn; Werner Kleinhans, Unna; Hans-Peter Rudrich, Windischeschenbach, all of Germany

[73] Assignee: Friedrich Grohe Aktiengesellschaft, Hemer, Germany

[21] Appl. No.: 488,489

[22] Filed: Jun. 8, 1995

[30] Foreign Application Priority Data

Jun. 10, 1994 [DE] Germany ..... 44 20 332.2

[51] Int. Cl.[6] ..... F16K 31/02

[52] U.S. Cl. ..... 251/129.04; 363/125

[58] Field of Search ..... 251/129.04; 363/125

[56] References Cited

U.S. PATENT DOCUMENTS

| | | | |
|---|---|---|---|
| 4,363,975 | 12/1982 | Beattie | 363/125 |
| 4,946,396 | 8/1990 | Saitoh . | |
| 4,962,354 | 10/1990 | Visser et al. | 363/125 |
| 5,079,688 | 1/1992 | Kido | 363/125 |
| 5,180,950 | 1/1993 | Nilssen | 363/125 |
| 5,243,717 | 9/1993 | Yasuo | 251/129.04 |

FOREIGN PATENT DOCUMENTS

| | | |
|---|---|---|
| 2655785 | 6/1991 | France . |
| 2721154 | 11/1978 | Germany . |
| 2140337 | 5/1990 | Japan . |
| 2226105 | 6/1990 | United Kingdom . |
| 2230150 | 10/1990 | United Kingdom . |
| WO90/02989 | 3/1990 | WIPO . |

*Primary Examiner*—John T. Kwon
*Attorney, Agent, or Firm*—Herbert Dubno; Andrew Wilford

[57] ABSTRACT

A plumbing fixture has a housing adapted to be secured to a support surface, forming a compartment dimensioned to snugly receive a battery, and formed with a passage extending from the compartment to the surface. Contacts exposed in the compartment are positioned to engage terminals of the battery. At least one feed conduit extends from the housing through a hole in the support surface so that liquid can be fed to the housing through the conduit. An electrically controlled valve in the housing is connected to the contacts and to the conduit for altering characteristics of fluid flow through the housing. A battery simulator is provided including a battery-replacement unit dimensioned like the battery, received in the compartment, and having terminals engaging the contacts. A flexible supply cable extends from the unit through the passage and surface and has an outer end outside the housing. A fitting on the outer end can fit with a standard line-voltage supply. Circuitry in the battery simulator converts alternating line-voltage current to low-voltage direct current and supplies the direct current to the terminals of the battery-replacement unit.

10 Claims, 3 Drawing Sheets

PLUMBING FIXTURE WITH LINE-POWERED CONTROL UNIT

SPECIFICATION

FIELD OF THE INVENTION

The present invention relates to a plumbing fixture, for instance a mixing faucet. More particularly this invention concerns such a fixture which has an electrically powered unit, for instance for controlling rate and/or temperature of the flow through the fixture.

BACKGROUND OF THE INVENTION

A plumbing fixture is known with an electrically powered control unit that can regulate the rate and/or temperature of the water flowing through the unit. For instance a mixing faucet can have manual temperature selection but an electrically powered on/off function that is tripped by means of an infrared or proximity sensor in the faucet. Thus as the user puts his or her hands under the spout, the valve is automatically opened to dispense water at the desired temperature, and when the hands are removed the water flow is cut off.

Such a system typically is powered by a heavy-duty lithium battery that has a relatively long service life. Nonetheless, once the battery is exhausted, the faucet does not work and it takes a relatively competent person to replace it. A module of the faucet must be pulled out and the battery taken out and replaced with a new one. This job is perfectly feasible for someone who is fairly handy, but imposing if not impossible for many.

OBJECTS OF THE INVENTION

It is therefore an object of the present invention to provide an improved electrically controlled plumbing fixture.

Another object is the provision of such an improved electrically controlled plumbing fixture which overcomes the above-given disadvantages, that is which avoids the complex battery-changing problem.

SUMMARY OF THE INVENTION

A plumbing fixture has according to the invention a housing adapted to be secured to a support surface, forming a compartment dimensioned to snugly receive a battery, and formed with a passage extending from the compartment to the surface. Contacts exposed in the compartment are positioned to engage terminals of the battery. At least one feed conduit extends from the housing through a hole in the support surface so that liquid can be fed under pressure to the housing through the conduit. An electrically controlled valve in the housing is connected to the contacts and to the conduit for altering characteristics of fluid flow through the housing. According to the invention a battery simulator is provided including a battery-replacement unit dimensioned like the battery, received in the compartment, and having terminals engaging the contacts. A flexible supply cable extends from the unit through the passage and surface and has an outer end outside the housing. A fitting on the outer end can fit with a standard line-voltage supply. Circuitry in the battery simulator converts alternating line-voltage current to low-voltage direct current and supplies the direct current to the terminals of the battery-replacement unit.

Thus it is possible according to the invention to eliminate the battery and power the fixture from the line voltage. This completely eliminates the need for the battery and provides long-term reliable service. The basic fixture remains substantially unchanged except for the provision of the cable passage which adds nothing to fabrication costs.

According to the invention the cable extends at least at the surface alongside the conduit and the fitting is a standard line-voltage plug. The circuitry includes a step-down transformer at the plug and a plug-and-socket connector outside the housing between the transformer and the valve. The circuit further has power-conditioning circuitry, a voltage regulator, and a rectifier. An RC storage system is provided for storing current and operating the valve in the event of a line-voltage power failure. The circuit includes means for converting an incoming alternating-current voltage of between 6 v and 24 v or a direct-current voltage of between 9 v and 32 v to a direct-current output voltage of 6 v. The circuit can also have means for monitoring the line voltage and for shutting down the valve in the event of a power outage and for reenergizing the valve only when the line voltage is restored.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
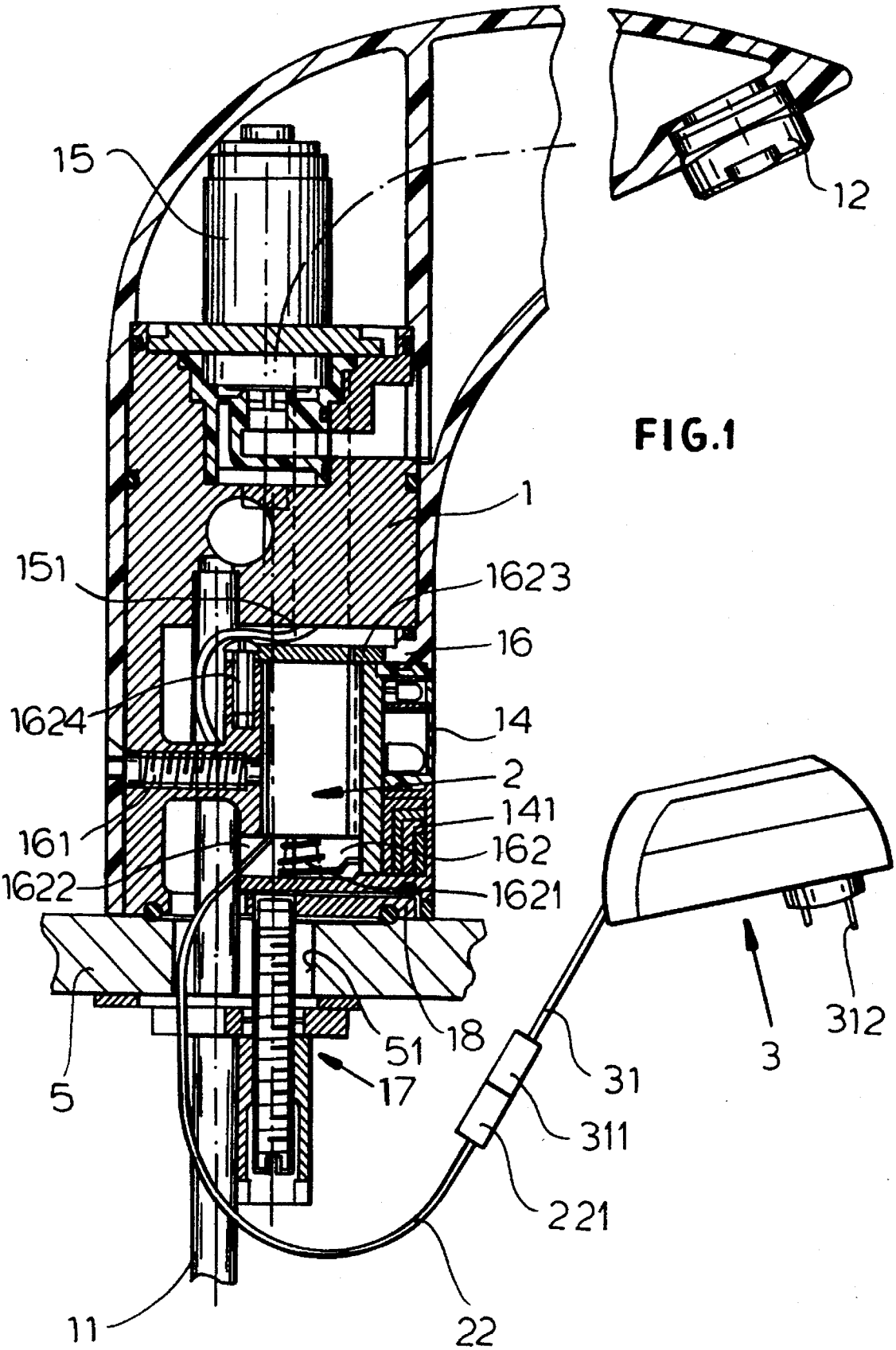
FIG. 1 is a vertical section through the valve assembly of this invention.
Figure 2:
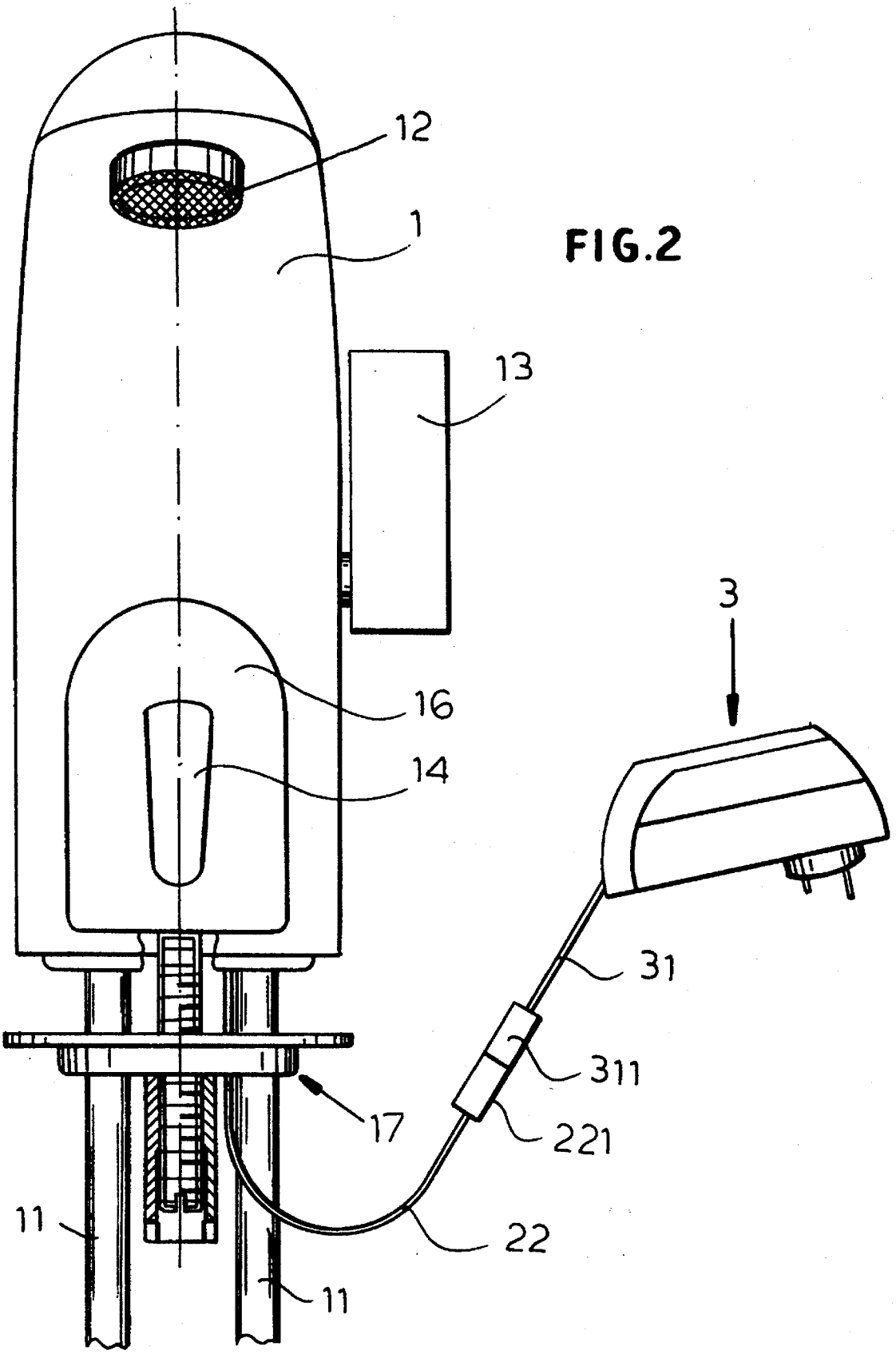
FIG. 2 is a front view of the assembly.

As seen in FIGS. 1 and 2 a mixing faucet according to this invention has a housing 1 adapted to be secured to the upper surface of a counter 5 formed with a throughgoing hole 51. A threaded bolt arrangement 17 secures the housing 1 solidly in place over the hole 51. Hot- and cold-water supply lines or conduits 11 project up through the hole 51 and are connected inside the valve housing 1 to an electrically operated valve 15. This valve 15 is turned on and off electrically but the mix temperature is adjusted manually by means of a side lever 13. The tempered-water output of the valve 15 is fed to a spout 12.

A sensor/control module 16 fitted to a forwardly open cavity in the housing 1 has a window 14 behind which is provided an infrared sensor 141. This module 15 is formed with a battery compartment 162 from which leads a passage 1622 that opens on the bottom of the housing 1 at the hole 51. Contacts 1621 are provided inside the compartment 162 for supplying direct-current voltage to the circuitry of the module 16. A screw 161 whose head is on the back of the housing 1 secures the module 16 in place. A flexible lead 151 runs from the module 16 to the valve 15 and a cover 1623 is secured in place by a screw 1624 to close the top of the compartment 162. This structure, with the exception of the passage 1622, is all standard.

Figure 7:
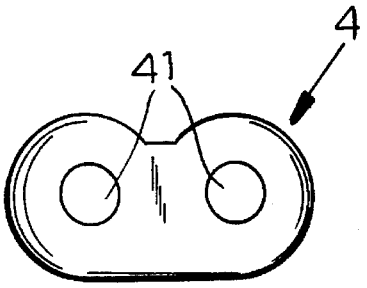
PRIOR ART FIG.7
FIGS. 6 and 7 are front and top views of the battery of the valve.
Figure 6:
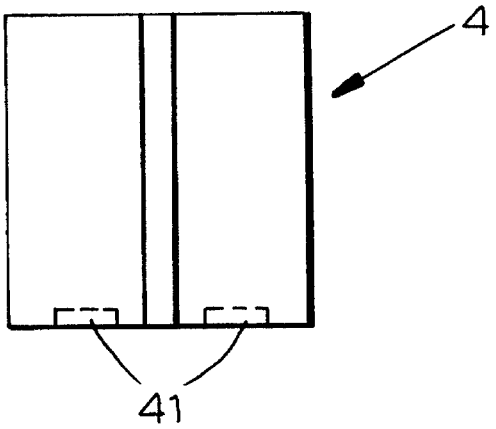
PRIOR ART FIG.6

The module of the prior art is normally powered by a 6 v lithium battery 4 of the type shown in FIGS. 6 and 7. This battery 4 has terminals 41 that engage the contacts 1621 of the compartment 162 and is dimensioned to fit snugly in the compartment 162.

Figure 4:
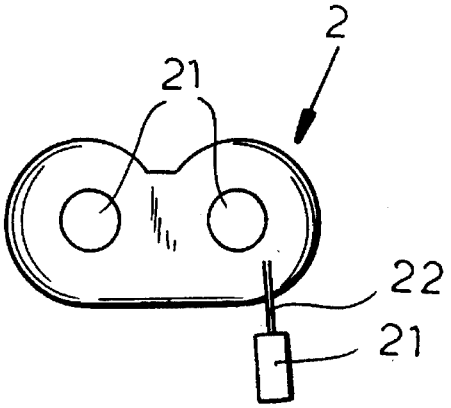
FIGS. 3 and 4 are front and top views of the battery simulator according to the invention.
Figure 3:
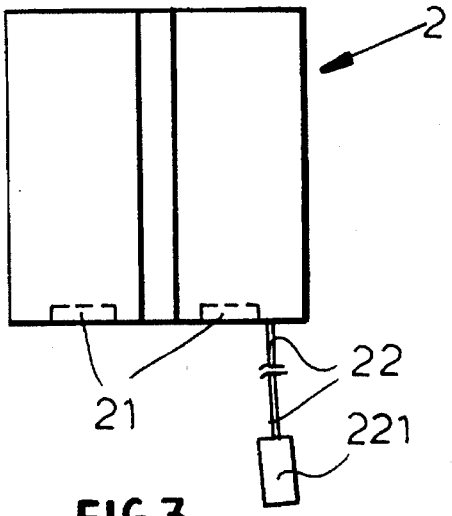

According to the invention a battery simulator 2 also shown in FIGS. 3 and 4 is of a shape identical to that of the battery 4 and has contacts 21 positioned identically to the contacts 41 so that this simulator 2 can take the exact place of the battery 4 in the compartment 162. An inner cable 22 leads from the simulator 2 through the passage 1622 and the hole 51 to an area below the counter 5 where it has a small two-conductor plug 221 that fits with a two-connector socket 311 mounted on the outer end of a two-conductor outer cable 31 connected to a plug/transformer unit 3 provided with a plug 312 adapted to be plugged into a standard line-voltage socket.

Figure 5:
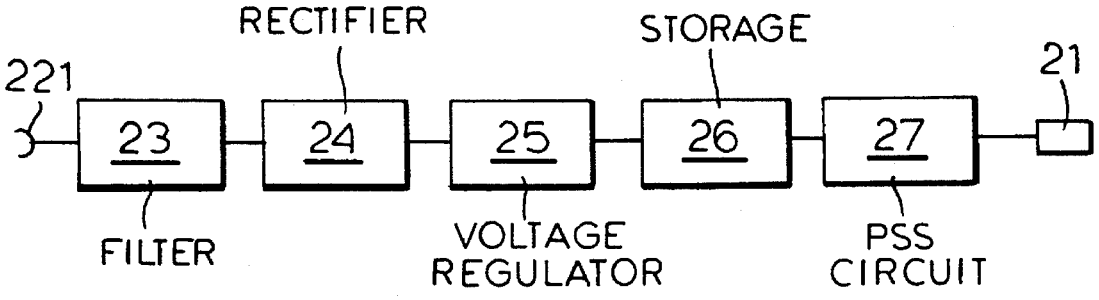
FIG. 5 is a schematic view of the simulator circuitry.

The battery simulator 2 includes as indicated schematically in FIG. 5 a line filter 23, a rectifier 24, a voltage regulator 25, a storage device 26, and a PSS circuit 27. The filter 23 serves to eliminate voltage peaks from the isolated low-voltage alternating current received from the step-down transformer 3. The rectifier 24 converts this incoming reduced a-c voltage to a pulsating d-c voltage. The voltage regulator 25 allows the use of various standard circuit elements with a wide voltage range while maintaining a solid output voltage. The storage unit 26 holds enough electrical energy to permit an orderly closing of the valve 15 when the line voltage fails. The PSS circuit monitors the entire circuit and only reconnects it when there is sufficient current and voltage available for proper running of the system.

This system can be retrofitted into a battery-powered faucet by removing the screw 161 so that the module 16 can be pulled forward out of the housing 1. The screw 1624 is then removed and the cover 1623 lifted and the old battery 4 is withdrawn and discarded. The line 22 is threaded down in the compartment 161 through the passage 122 and through the hole 51 and the simulator 2 is dropped into the compartment 161 so its terminals 21 sit on the contacts 1621. Then the cover 1623 and screw 1624 are replaced and the module 16 is reinserted and secured by the screw 161, the lead 151 being long enough to permit this movement.

Underneath the counter 5 the plug 221 is fitted to the socket 311 and the plug 312 is plugged into a wall socket, although hard wiring of the transformer 3 is possible. The conversion is complete.

We claim:

1. A plumbing fixture comprising:

a housing adapted to be secured to a support surface, forming a compartment dimensioned to snugly receive a battery, and formed with a passage extending from the compartment to the surface;

contacts exposed in the compartment and positioned to engage terminals of the battery;

at least one feed conduit extending from the housing through the support surface, whereby liquid is fed to the housing through the conduit;

electrically controlled valve means in the housing connected to the contacts and to the conduit for altering characteristics of fluid flow through the housing; and a battery simulator including a battery-replacement unit dimensioned like the battery, received in the compartment, and having terminals engaging the contacts, a flexible supply cable extending from the unit through the passage and surface and having an outer end outside the housing, a fitting on the outer end adapted to be fitted to a standard line-voltage supply, and circuit means including power-conditioning circuitry for converting alternating line-voltage current to low-voltage direct current and for supplying the direct current to the terminals of the battery-replacement unit.

2. The plumbing fixture defined in claim 1 wherein the cable extends at least at the surface alongside the conduit.

3. The plumbing fixture defined in claim 1 wherein the fitting is a standard line-voltage plug.

4. The plumbing fixture defined in claim 3 wherein the circuit means includes a step-down transformer at the plug and a plug-and-socket connector outside the housing between the transformer and the valve means.

5. The plumbing fixture defined in claim 1 wherein the circuitry includes a voltage regulator.

6. The plumbing fixture defined in claim 1 wherein the circuitry includes a rectifier.

7. The plumbing fixture defined in claim 1 wherein the circuitry includes storage means for storing current and operating the valve means in the event of a line-voltage power failure.

8. The plumbing fixture defined in claim 1 wherein the circuit means includes means for converting an incoming alternating-current voltage to a direct-current output voltage of 6 v.

9. The plumbing fixture defined in claim 1 wherein the circuit means includes means for monitoring the line voltage and for shutting down the valve means in the event of a power outage and for reenergizing the valve means only when the line voltage is restored.

10. A plumbing fixture for use on a support surface formed with a throughgoing hole, the fixture comprising:

a housing adapted to be secured to the support surface over the hole thereof, forming a compartment dimensioned to snugly receive a battery, and formed with a passage extending from the compartment to the hole;

contacts exposed in the compartment and positioned to engage terminals of the battery;

at least one feed conduit extending from the housing through the hole, whereby liquid is fed to the housing through the conduit;

electrically controlled valve means in the housing connected to the contacts and to the conduit for altering characteristics of fluid flow through the housing; and a battery simulator including a battery-replacement unit dimensioned like the battery, received in the compartment, and having terminals engaging the contacts, a flexible inner supply cable extending from the unit through the passage and hole and having an outer end outside the housing and provided with an inner plug, a flexible outer supply cable having an inner socket fittable with the inner plug and an outer end, a step-down transformer on the outer end and provided with an outer plug adapted to be fitted to a standard line-voltage supply, and circuit means in the housing including power-conditioning circuitry connected to one of the cables for converting alternating line-voltage current from the transformer to low-voltage direct current and for supplying the direct current to the terminals of the battery-replacement unit.

* * * * *